US005994950A

United States Patent [19]

Ochi

[11] Patent Number: 5,994,950

[45] Date of Patent: Nov. 30, 1999

[54] REGULATOR BUILT-IN SEMICONDUCTOR INTEGRATED CIRCUIT

[75] Inventor: Masatoshi Ochi, Tokyo, Japan

[73] Assignee: NEC Corporation, Tokyo, Japan

[21] Appl. No.: 08/974,156

[22] Filed: Nov. 19, 1997

[30] Foreign Application Priority Data

Nov. 19, 1996 [JP] Japan ..... 8-307894

[51] Int. Cl.[6] ..... G05F 1/10

[52] U.S. Cl. ..... 327/543; 327/538; 327/540

[58] Field of Search ..... 327/313, 316, 327/407, 408, 538, 540, 541, 543

[56] References Cited

U.S. PATENT DOCUMENTS

| | | | |
|---|---|---|---|
| 5,184,031 | 2/1993 | Hayakawa et al. | 307/296.3 |
| 5,347,170 | 9/1994 | Hayakawa et al. | 307/296.1 |
| 5,349,559 | 9/1994 | Park et al. | 365/201 |
| 5,504,452 | 4/1996 | Takenaka | 327/541 |
| 5,557,232 | 9/1996 | Shimagowa | 327/545 |
| 5,631,547 | 5/1997 | Fujioka et al. | 323/273 |
| 5,712,586 | 1/1998 | Kitao | 327/333 |

FOREIGN PATENT DOCUMENTS

| | | |
|---|---|---|
| 0461788 | 12/1991 | European Pat. Off. . |
| 2680585 | 2/1993 | France . |
| 4-340112 | 11/1992 | Japan . |
| 5-74140 | 3/1993 | Japan . |
| 6-140575 | 5/1994 | Japan . |
| 7-211869 | 8/1995 | Japan . |
| 8-272461 | 10/1996 | Japan . |
| 9-8632 | 1/1997 | Japan . |

*Primary Examiner*—Timothy P. Callahan
*Assistant Examiner*—An T. Luu
*Attorney, Agent, or Firm*—Foley & Lardner

[57] ABSTRACT

A semiconductor integrated circuit includes an internal circuit, a first external power supply connection terminal, a regulator, an external control terminal, transistors, and a second external power supply connection terminal. The internal circuit has first and second operation modes. The internal circuit is driven with different power supply voltages in the first and second modes. An external power supply voltage is supplied to the first external power supply connection terminal when at least the first operation mode is selected. The regulator steps down the external power supply voltage supplied from the first external power supply connection terminal, and supplies the stepped-down voltage to the internal circuit. The external control terminal receives an ON/OFF control signal corresponding to the first or second operation mode. The transistors set the regulator in an enable/disable state based on the ON/OFF control signal supplied from the external control terminal. The second external power supply connection terminal directly supplies the external power supply voltage to the internal circuit when the second mode is selected.

13 Claims, 4 Drawing Sheets

REGULATOR BUILT-IN SEMICONDUCTOR INTEGRATED CIRCUIT

BACKGROUND OF THE INVENTION

The present invention relates to a semiconductor integrated circuit having a built-in regulator that steps down an external power supply voltage and supplies it to an internal circuit and, more particularly, to a regulator built-in semiconductor integrated circuit which can be used in both a low-voltage/low-consumption current mode and a high-voltage/high-speed operation mode.

Conventionally, semiconductor integrated circuits having equivalent functions are provided as different chips having different design specifications if they have different conditions for use, e.g., different current consumption and a different operation speed. For example, a semiconductor integrated circuit which has a low operation speed but operates with a low current consumption has a built-in regulator which steps down an external power supply voltage and supplies it to an internal circuit. In contrast to this, in a semiconductor integrated circuit which is designed to achieve a high-speed operation, its internal circuit is driven by a voltage substantially equal to the external power supply voltage, so that it operates at a high speed.

If these semiconductor integrated circuits have a common function, they often have a common internal circuit that achieves a specific function as the semiconductor integrated circuit. In this case, one semiconductor integrated circuit can be desirably used in different modes under different conditions, i.e., different current consumptions and different clock frequencies.

More specifically, if one semiconductor integrated circuit can be used in both the low-voltage/low-consumption current mode and the high-voltage/high-speed operation mode, semiconductor integrated circuits that can be used in different conditions can be manufactured with a common mask. This is preferable in terms of the manufacturing process and manufacturing cost as well. Even if the use conditions differ, since a common internal circuit is used, common software that operates the semiconductor integrated circuit can be used.

FIG. 3 shows the arrangement of a conventional regulator built-in semiconductor integrated circuit. Referring to FIG. 3, a semiconductor integrated circuit 3 has an internal circuit 34 for receiving data I0 to Ip and outputting data O0 to Oq, and a regulator 32 for supplying power to the internal circuit 34. The regulator 32 is built in the semiconductor integrated circuit 3, and steps down an external power supply voltage VDDM, e.g., 5 V, which is supplied to an external power supply connection terminal 31, to 2.8 V and supplies the stepped-down voltage to the internal circuit 34 through an internal power supply wiring 33. This decreases current consumption.

In this arrangement, the semiconductor integrated circuit 3 operates with a 6-MHz clock frequency and decreases power consumption of the internal circuit 34. A terminal 35 is a connection terminal to which a capacitance (capacitor) 36 is connected to stabilize the output voltage of the regulator 32.

FIG. 4 shows the arrangement of the regulator 32 shown in FIG. 3. Referring to FIG. 4, the regulator 32 is constituted by a reference voltage generating circuit 321, a comparator 322, an output control transistor 323, and an output resistor 324. The reference voltage generating circuit 321 generates a reference voltage. The comparator 322 compares the reference voltage with the output voltage of the regulator 32 and outputs a control signal corresponding to a difference between them. The output control transistor 323 controls the output of the regulator 32 based on the control signal output from the comparator 322. The output resistor 324 is connected in series with the output control transistor 323.

In the regulator 32 having the above arrangement, the comparator 322 compares the output voltage with the reference voltage. A difference signal between the output voltage and reference voltage drives the output control transistor 323 to supply a predetermined voltage to the internal circuit 34 through the internal power supply wiring 33. An external voltage is supplied t o the reference voltage generating circuit 321 and comparator 322 through the external power supply connection terminal 31.

In the conventional semiconductor integrated circuit 3 described above, however, since only the voltage which is stepped down by the regulator 32 is supplied to the internal circuit 34 through the internal power supply wiring 33, an external power supply voltage cannot be supplied to the internal circuit 34. Even when the internal circuit 34 can be operated at a high speed with a 12-MHz clock frequency by supplying, e.g., an external power supply voltage 5 V, to it, the semiconductor integrated circuit 3 having the built-in regulator 32 cannot be used in an application that requires a high-speed operation with a higher clock frequency.

This also applies to a case wherein the output voltage of the regulator 32 is variable and the external power supply voltage is to be supplied from the external power supply connection terminal 31 through the regulator 32. More specifically, since a voltage drop occurs in the output control transistor 323, the external power supply voltage of 5 V cannot be directly supplied to the internal circuit 34.

When the external power supply voltage is to be directly supplied from the external power supply connection terminal 31 to the internal circuit 34, a switching transistor must be arranged on the line extending from the external power supply connection terminal 31 to the internal power supply wiring 33. In this case, a power capacity W of the switching transistor must be sufficiently large so that the switching transistor has a current supply ability that can cope with a change in load. Then, a large layout area is needed, leading to a large chip size.

SUMMARY OF THE INVENTION

It is an object of the present invention to provide a regulator built-in semiconductor integrated circuit in which the same semiconductor integrated circuit can be used in different conditions, i.e., in the low-voltage/low-consumption current mode and in the high-voltage/high-speed operation mode without increasing the chip size.

In order to achieve the above object, according to the present invention, there is provided a semiconductor integrated circuit comprising an internal circuit having first and second operation modes, the internal circuit being driven with different power supply voltages in the first and second modes, a first external power supply connection terminal to which an external power supply voltage is supplied when at least the first operation mode is selected, a regulator for stepping down the external power supply voltage supplied from the first external power supply connection terminal and supplying the stepped-down voltage to the internal circuit, an external control terminal for receiving an ON/OFF control signal corresponding to the first or second operation mode, control means for setting the regulator in an enable/disable state based on the ON/OFF control signal supplied from the external control terminal, and a second external power supply connection terminal for directly supplying the external power supply voltage to the internal circuit when the second mode is selected.

DESCRIPTION OF THE PREFERRED EMBODIMENT

The present invention will be described in detail with reference to the accompanying drawings.

Figure 1:
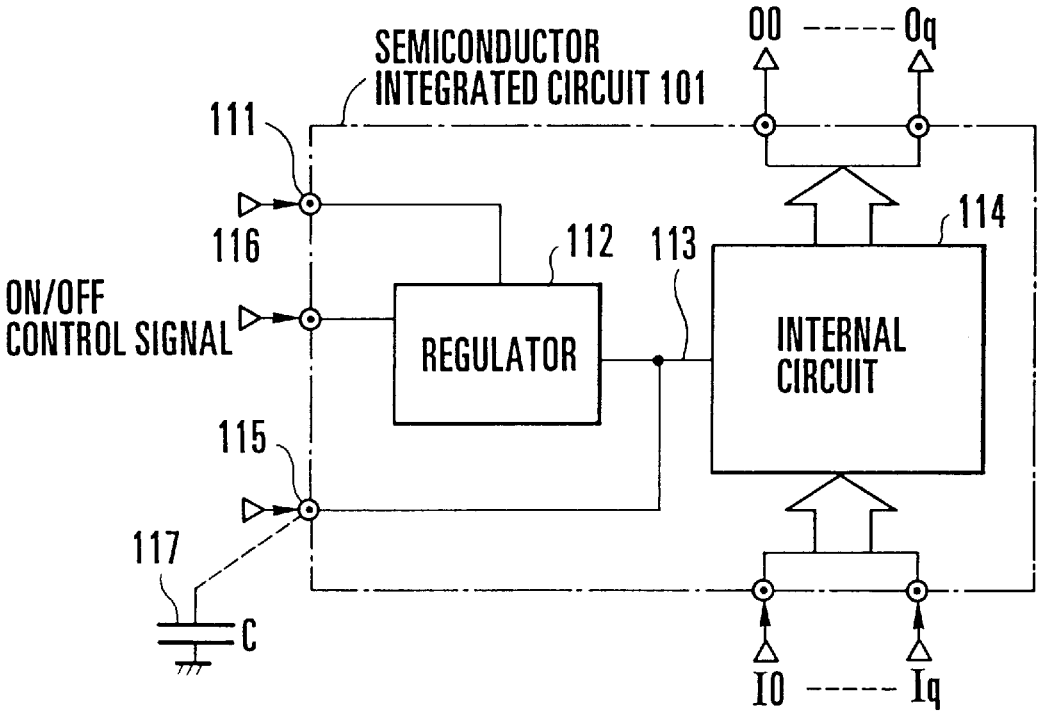
FIG. 1 is a block diagram of a semiconductor integrated circuit according to an embodiment of the present invention.

FIG. 1 shows a semiconductor integrated circuit according to an embodiment of the present invention. Referring to FIG. 1, a semiconductor integrated circuit 101 has an internal circuit 114 for receiving data I0 to Ip and outputting data O0 to Oq, and a regulator 112 for stepping down an external power supply voltage and supplying it to the internal circuit 114 through an internal power supply wiring 113. The semiconductor integrated circuit 101 further has an external control terminal 116 for inputting an ON/OFF control signal to the regulator 112, and two external power supply connection terminals 111 and 115.

In the regulator built-in semiconductor integrated circuit 101 having the above arrangement, when an ON signal is input to the external control terminal 116, the semiconductor integrated circuit 101 operates with a 6-MHz clock frequency. When an OFF signal is input to the external control terminal 116, the semiconductor integrated circuit 101 operates at a high speed with a 12-MHz clock frequency.

The regulator 112 has control elements (to be described later) for turning on/off the regulating operation based on the ON/OFF signal input to the external control terminal 116. The external power supply connection terminal 111 serves for supplying the external power supply voltage to the regulator 112 when the regulator 112 is to be used, i.e., in the low-voltage/low-consumption current mode. The external power supply connection terminal 115 is connected to the output side of the regulator 112 and directly supplies an external power supply voltage VDD (5 V) to the internal circuit 114 through the internal power supply wiring 113 in the high-voltage/high-speed operation mode. It will be understood that the external power supply voltage VDD is not connected to the external power supply connection terminal 115 in the low-voltage/low consumption current mode. Terminals, e.g., a clock signal input terminal, other than those described above are not illustrated.

Figure 2:
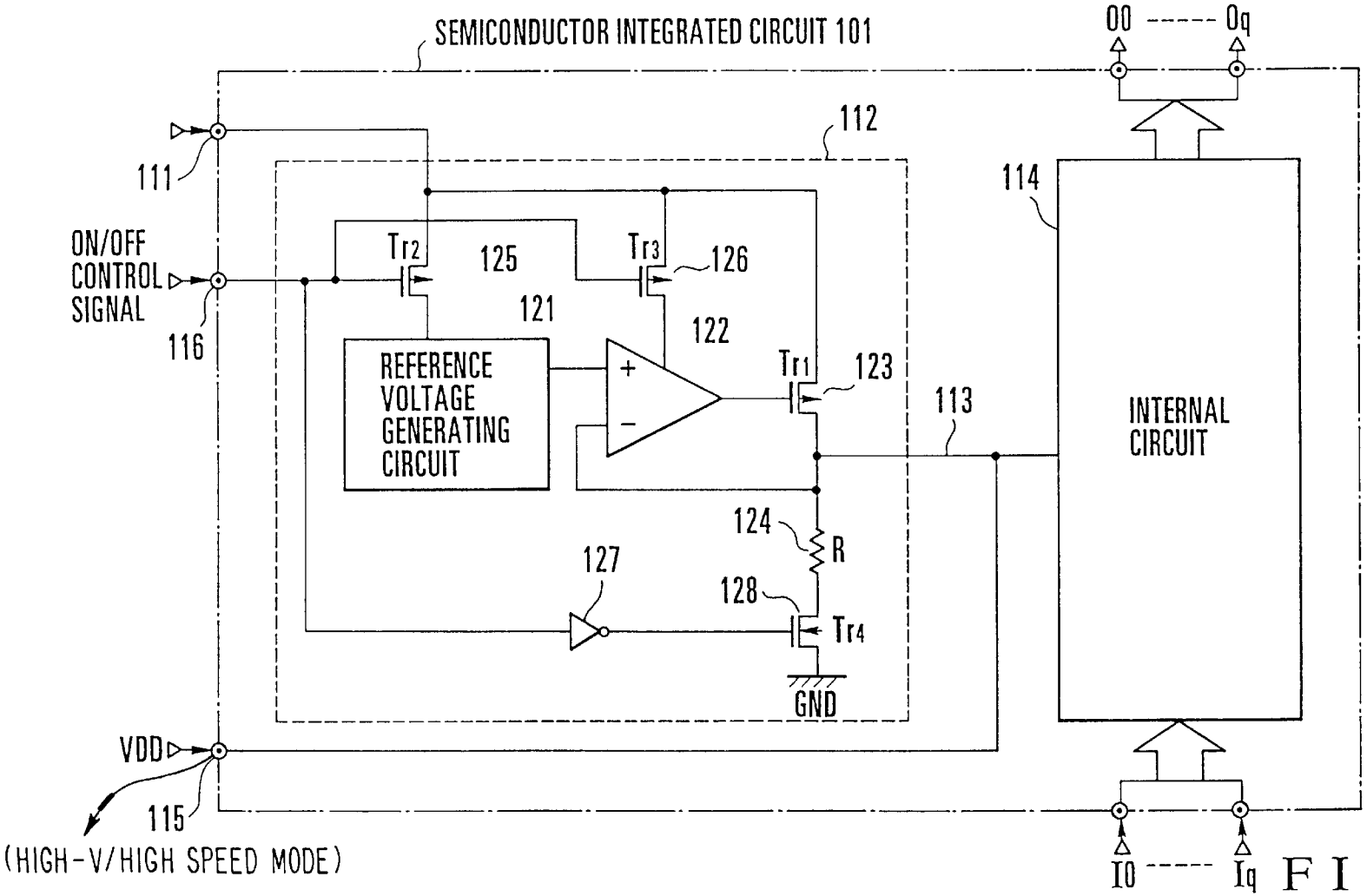
FIG. 2 is a circuit diagram of the semiconductor integrated circuit showing in detail the regulator shown in FIG. 1.
Figure 3:
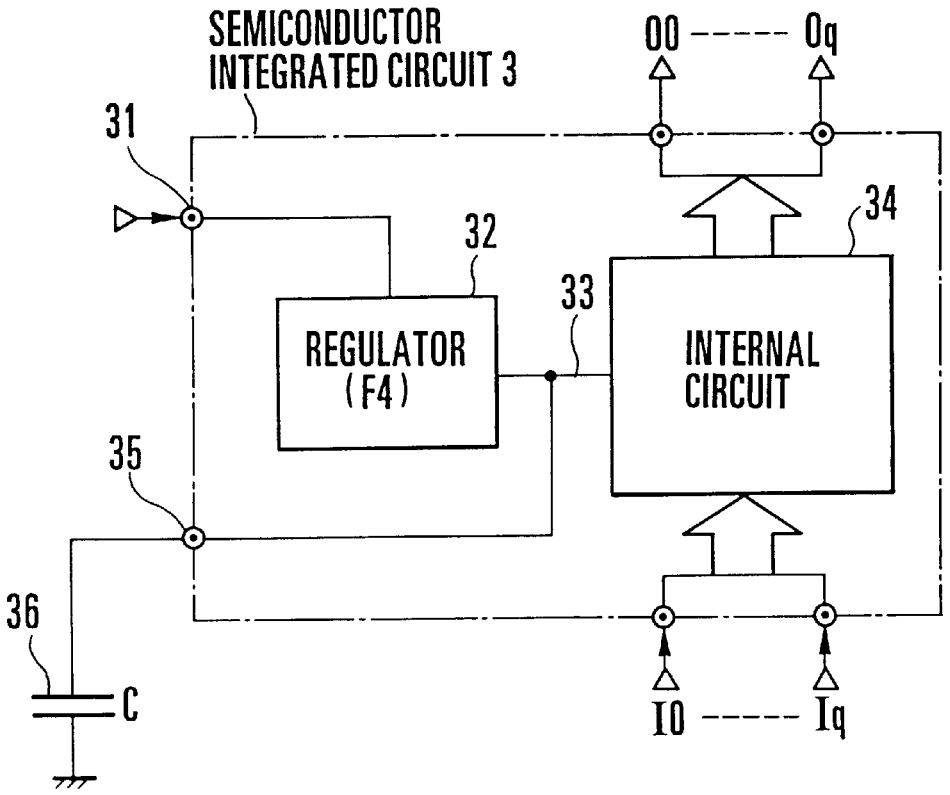
F I G. 3 PRIOR ART
FIG. 3 is a circuit diagram of a conventional regulator built-in semiconductor integrated circuit.
Figure 4:
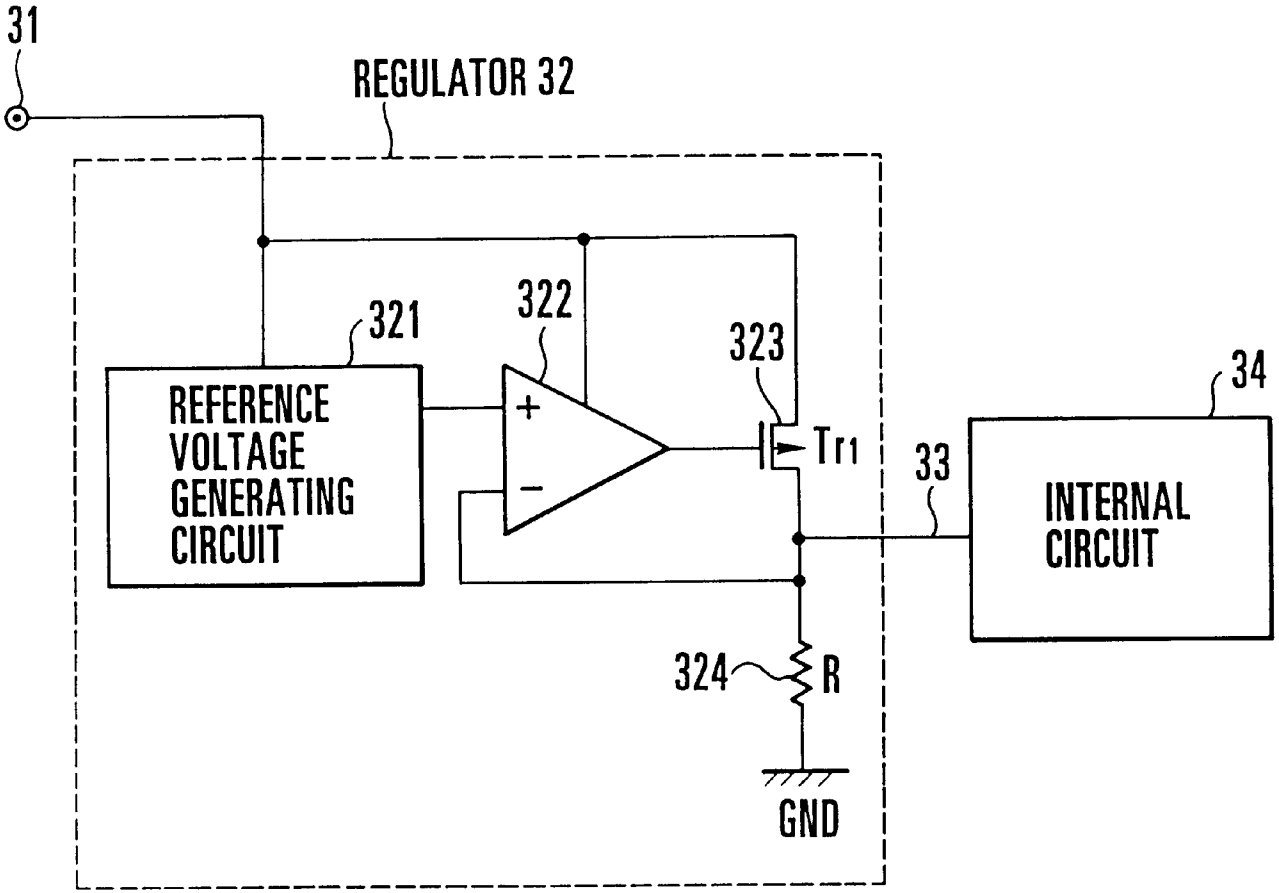
FIG. 4 PRIOR ART
FIG. 4 is a block diagram of the regulator of the semiconductor integrated circuit shown in FIG. 3.

FIG. 2 shows an example of the semiconductor integrated circuit showing in detail the arrangement of the regulator 112 shown in FIG. 1. Referring to FIG. 2, the regulator 112 has a reference voltage generating circuit 121, a comparator 122, an output control transistor (Tr1) 123, transistors (Tr2 to Tr4) 125, 126, and 128 serving as the control elements described above, an output resistor 124, and an inverter 127. The reference voltage generating circuit 121 comprises a Zener diode that generates a reference voltage. The comparator 122 compares the reference voltage generated by the reference voltage generating circuit 121 with the output voltage of the regulator 112 and outputs a control signal corresponding to a change in output voltage. The output resistor 124 is connected in series with the transistor 123. The inverter 127 is connected to the gate of the transistor 128.

The transistor 123 comprises a p-type MOS transistor and controls the output level of the regulator 112 based on the control signal output from the comparator 122. The comparator 122 compares the output voltage of the regulator 112 with the reference voltage output from the reference voltage generating circuit 121 and drives the transistor 123 with a difference signal indicating a difference between the output voltage and the reference voltage. With this arrangement, the external power supply voltage VDD (5 V) supplied from the external power supply connection terminal 111 is stepped down to 2.8 V and is supplied to the internal circuit 114 through the internal power supply wiring 113.

The transistors 125 and 126 respectively comprise enhancement type MOS transistors, the gates of which receive an ON/OFF control signal output from the external control terminal 116, and are connected to the power supply lines extending from the external power supply connection terminal 111 to the reference voltage generating circuit 121 and comparator 122, respectively. The transistors 125 and 126 serve as switching elements and turn on/off power supply to the reference voltage generating circuit 121 and comparator 122, respectively, in accordance with the ON/OFF control signal input to their gates through the external control terminal 116.

With this arrangement, when an "L" level signal is given to the external control terminal 116 as the ON signal, the two transistors 125 and 126 are turned on to supply power to the reference voltage generating circuit 121 and comparator 122, respectively. The comparator 122 is turned on, i.e., is set in the enable state. When an "H" level signal is supplied to the external control terminal 116 as the OFF signal, both the transistors 125 and 126 are turned off to cut power supply from the reference voltage generating circuit 121 and comparator 122, respectively. As a result, the regulator 112 is turned off, i.e., is set in the disable state.

The transistor 128 comprises an NMOS transistor, the gate of which receives the ON/OFF control signal supplied from the external control terminal 116 through the inverter 127, and is connected in series with an output circuit consisting of the transistor 123 and output resistor 124 at the output stage of the regulator 112.

With this arrangement, when an ON signal, i.e., an "L" level signal, is input to the external control terminal 116, the transistor 128 is turned on to constitute the output circuit of the regulator 112. When an OFF signal, i.e., an "H" level signal, is input to the external control terminal 116, the transistor 128 is turned off. Accordingly, when power supply to the reference voltage generating circuit 121 and comparator 122 is cut by the OFF signal input to the external control terminal 116 to set the regulator 112 in the disable state, the transistor 128 cuts the current flowing from the external power supply connection terminal 111 to the GND through the output control transistor 123 (Tr1) and the resistor (R) 124. Simultaneously, the transistor 128 also cuts the current flowing from the external power supply connection terminal 115 to the GND of the regulator 112 through the internal power supply wiring 113.

The semiconductor integrated circuit 101 having the above arrangement can be used both in the low-voltage/low-consumption current mode and the high-voltage/high-speed operation mode by inputting the ON/OFF control signal to the external control terminal 116 to selectively set the regulator 112 in the enable/disable state.

This will be described in detail. When the semiconductor integrated circuit 101 is to be used in the low-voltage/low-consumption current mode, an ON signal is input to the external control terminal 116 to set the regulator 112 in the enable state. Then, the external power supply is connected to the external power supply connection terminal 111. The regulator 112 steps down the external power supply voltage VDD (5 V) input through the external power supply connection terminal 111 to 2.8 V and supplies it to the internal circuit 114 through the internal power supply wiring 113. At this time, the internal circuit 114 operates with a 6-MHz clock frequency, so that the current consumed by the semiconductor integrated circuit 101 decreases.

When the semiconductor integrated circuit 101 is to be used in the high-voltage/high-speed operation mode, an OFF signal is input to the external control terminal 116 to set the regulator 112 in the disable state. Then, the external power supply is connected to the external power supply connection terminal 111 and external power supply connection terminal 115. The external power supply voltage VDD is directly supplied from the external power supply connection terminal 115 to the internal circuit 114 through the internal power supply wiring 113, and the internal circuit 114 operates at a speed with a 12-MHz clock frequency.

At this time, the external power supply voltage is supplied to a external power supply connection terminal 111 as well in order to eliminate a potential difference between the source and drain of the output control transistor 123 in the regulator 112, so a current does not flow from the external power supply connection terminal 115 to the external power supply connection terminal 111.

The external power supply connection terminal 115 is connected to the internal power supply wiring 113, i.e., to the output of the regulator 112. Therefore, a capacitance 117 that stabilizes the output voltage of the regulator 112 can be connected to the external power supply connection terminal 115, as shown in FIG. 1. More specifically, the external power supply connection terminal 115 can also serve as a connection terminal to which an output voltage stabilizing capacitance is connected.

At this time, the external power supply connection terminal 115 can be connected to the output stabilizing capacitance 117 not only in the low-voltage/low-consumption current mode where the regulator 112 is set in the enable state, but also in the high-voltage/high-speed operation mode where the regulator 112 is set in the disable state. In this case, the output stabilizing capacitance 117 serves as a bypass capacitor between the external power supply and GND.

Since the transistors 125, 126, and 128 arranged as the switching elements of the regulator 112 do not supply any current to the internal circuit 114, they need not have a large power capacity W. As a result, a large layout area is not required, and the chip size of the semiconductor integrated circuit 101 does not increase.

In the above description, although the clock frequency in the low-voltage/low-consumption current mode and that in the high-voltage/high-speed operation mode are respectively 6 MHz and 12 MHz, the clock frequencies are not limited to them when practicing the present invention.

Although the description was made by setting the regulation voltage supplied by the regulator 112 to the internal circuit 114 to 2.8 V, the regulation voltage in the low-voltage/low-consumption current mode of the semiconductor integrated circuit according to the present invention is not limited to this.

As has been described above, according to the present invention, the semiconductor integrated circuit having one built-in regulator can be used in different modes, i.e., in the low-voltage/low-consumption current mode and in the high-voltage/high-speed operation mode by switching. Therefore, one type of common semiconductor integrated circuit can be used for a plurality of products having, e.g., different operation speeds.

Different types of integrated circuits need not be designed and fabricated in accordance with the condition for use, i.e., in accordance with the modes. Since these integrated circuits can be fabricated with one mask, the manufacturing cost of the regulator built-in semiconductor integrated circuit can be decreased. Since a common internal circuit can be used, common software can be used, thus decreasing time and cost required for development of the software.

The external power supply connection terminal for directly supplying the external power supply voltage to the internal circuit can also serve as an output voltage stabilizing capacitance connection terminal. When compared to the conventional regulator built-in semiconductor integrated circuit, the number of terminals, excluding the external control terminal, is not increased.

Since the control means for turning on/off the regulator does not require a transistor having a large power capacity, i.e., a large W, a regulator built-in semiconductor integrated circuit that can be used in different operating conditions can be provided without increasing the chip size.

What is claimed is:

1. A semiconductor integrated circuit comprising:

an internal circuit having first and second operation modes, the internal circuit being driven with different power supply voltages in the first and second modes;

a first external power supply connection terminal to which an external power supply voltage is supplied;

a regulator for stepping down the external power supply voltage supplied from the first external power supply connection terminal and supplying the stepped-down voltage to the internal circuit;

an external control terminal for receiving an ON/OFF control signal corresponding to the first or second operation mode, the ON/OFF control signal selectively enabling and disabling the regulator;

a second external power supply connection terminal, the second external power supply connection terminal being directly connected to the internal circuit;

a first switch selectively connecting the first external power supply terminal and the regulator based on the ON/OFF control signal supplied from the external control terminal; and a second switch selectively connecting an output resistor disposed on an output stage of the regulator to a reference voltage based on the ON/OFF control signal supplied from the external control terminal.

2. A circuit according to claim 1, wherein said second external power supply connection terminal is connected to an output of said regulator.

3. A circuit according to claim 1, wherein the first switch disconnects the first external power supply connection terminal from the regulator when the ON/OFF control signal supplied from the external control terminal is an OFF signal, and the second switch prevents current from flowing from the second external power supply connection terminal to the regulator when the ON/OFF control signal supplied from the external control terminal is an OFF signal.

4. A circuit according to claim 1, wherein the regulator is comprised of:

a reference voltage generating circuit, the reference voltage generating circuit generating a reference voltage from the external power supply voltage supplied from the first external power supply connection terminal, a comparator that compares an output voltage of the regulator with the reference voltage output from the reference voltage generating circuit and outputs a control signal in accordance with a comparison result, and an output control transistor that controls a current flowing through an output resistor in accordance with the control signal output from the comparator.

5. A circuit according to claim 1, wherein the first switch is comprised of a PMOS transistor, and the second switch is comprised of an NMOS transistor.

6. A circuit according to claim 1, wherein the first and second external power supply connection terminals are both supplied with the external power supply voltage when the second operation mode is selected.

7. A circuit according to claim 1, wherein the first operation mode is a low-voltage/low-consumption current mode and the second operation mode is a high-voltage/high-speed operation mode.

8. A circuit according to claim 1, wherein the first external power supply voltage is about 5 V, and the regulator steps down the first external power supply voltage to about 2.8 V.

9. A semiconductor integrated circuit comprising:

an internal circuit operable in a first mode and in a second mode, the first mode corresponding to a low voltage/low current consumption mode and the second mode corresponding to a high voltage/high current consumption mode;

a first external power supply connection terminal to which an external power supply voltage is supplied when the first operation mode is selected;

a regulator for stepping down the external power supply voltage supplied from the first external power supply connection terminal and supplying the stepped-down voltage to the internal circuit;

an external control terminal for receiving an ON/OFF control signal;

a first switch selectively connecting the first external power supply terminal and the regulator based on the ON/OFF control signal supplied from the external control terminal, whereby the ON/OFF control signal selectively enables and disables the regulator;

a second switch selectively connecting on an output stage of the regulator to a reference voltage based on the ON/OFF control signal supplied from the external control terminal; and a second external power supply connection terminal to which the external power supply voltage is supplied when the second mode is selected, the second external power supply connection terminal directly supplying the external power supply voltage to the internal circuit.

10. A circuit according to claim 9, wherein the first switch selectively connecting the first external power supply terminal and the regulator disconnects the first external power supply connection terminal from the regulator when the ON/OFF control signal supplied from the external control terminal is an OFF signal, and the second switch prevents current flowing from the second external power supply connection terminal to the regulator when the ON/OFF control signal supplied from the external control terminal is an OFF signal.

11. A circuit according to claim 9, wherein the regulator is comprised of:

a reference voltage generating circuit that generates a reference voltage from the first external power supply voltage supplied from the first external power supply connection terminal, a comparator that compares an output voltage of the regulator with the reference voltage output from the reference voltage generating circuit and outputs a control signal in accordance with a comparison result, and an output control transistor that controls a current flowing through an output resistor in accordance with the control signal output from the comparator.

12. A circuit according to claim 9, wherein the first switch selectively connecting the first external power supply terminal and the regulator is comprised of a PMOS transistor, and the second switch is comprised of an NMOS transistor.

13. A circuit according to claim 9, wherein the first and second external power supply connection terminals are both supplied with the external power supply voltage when the second operation mode is selected.

* * * * *